US011060358B2

(12) United States Patent
Plunkett et al.

(10) Patent No.: US 11,060,358 B2
(45) Date of Patent: Jul. 13, 2021

(54) EARTH-BORING DRILL BIT WITH A DEPTH-OF-CUT CONTROL (DOCC) ELEMENT INCLUDING A ROLLING ELEMENT

(71) Applicant: Halliburton Energy Services, Inc., Houston, TX (US)

(72) Inventors: Kelley Leigh Plunkett, The Woodlands, TX (US); Jordan Olear, Missouri City, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 70 days.

(21) Appl. No.: 16/446,199

(22) Filed: Jun. 19, 2019

(65) Prior Publication Data

US 2020/0399961 A1 Dec. 24, 2020

(51) Int. Cl.

| | |
|---|---|
| ***E21B 10/42*** | (2006.01) |
| ***E21B 10/567*** | (2006.01) |
| ***E21B 12/00*** | (2006.01) |

(52) U.S. Cl.

CPC ..... *E21B 12/00* (2013.01); *E21B 10/42* (2013.01); *E21B 10/567* (2013.01)

(58) Field of Classification Search

CPC ..... E21B 10/43; E21B 10/42; E21B 10/567; E21B 10/62; E21B 10/627; E21B 10/633; E21B 10/5671

See application file for complete search history.

(56) References Cited

U.S. PATENT DOCUMENTS

| | | | | |
|---|---|---|---|---|
| 9,976,353 | B2 * | 5/2018 | Hinz | E21B 10/55 |
| 10,066,439 | B2 * | 9/2018 | Hinz | E21B 10/08 |
| 10,323,465 | B2 * | 6/2019 | Chen | E21B 10/42 |
| 10,760,342 | B2 * | 9/2020 | Hinz | E21B 10/54 |
| 10,801,269 | B1 * | 10/2020 | Hankins | E21B 10/42 |
| 2016/0168918 | A1 | 6/2016 | Overstreet et al. | |

OTHER PUBLICATIONS

"Cruzer™ Depth-of-Cut Rolling Element," Halliburton Energy Services, Inc., H012380, Nov. 2016, 1 page.

"Cruzer™ Depth-of-Cut Rolling Element Greatly Reduces Curve Drilling Time," Halliburton Energy Services, Inc., H012764, Dec. 2017, 2 pages.

"GeoTech™ Fixed Cutter PDS Bits," Halliburton Energy Services, Inc., H011443, Jan. 2015, 2 pages.

* cited by examiner

*Primary Examiner* — Catherine Loikith

(74) *Attorney, Agent, or Firm* — Thomas Rooney; Baker Botts L.L.P.

(57) ABSTRACT

An earth-boring drill bit with brazed-in rolling elements for depth-of-cut control. The earth-boring drill bit includes a bit body, a blade having an exterior surface and defining at least one pocket, and a DOCC element positioned within the blade. The DOCC element includes a walled retainer positioned within the pocket. The walled retainer includes retainer side walls and an endcap attached to the retainer side walls at an end of the walled retainer. The DOCC element further includes a rolling element positioned within and partially enclosed by walled retainer, with a portion thereof extending above the exterior surface of the blade. The disclosure further includes the DOCC element and a method of installing it in the pocket defined by the blade.

19 Claims, 6 Drawing Sheets

EARTH-BORING DRILL BIT WITH A DEPTH-OF-CUT CONTROL (DOCC) ELEMENT INCLUDING A ROLLING ELEMENT

TECHNICAL FIELD

The present disclosure relates generally to downhole drilling tools, and in particular to an earth-boring drill bit with a depth-of-cut control (DOCC) element including a rolling element, and systems and methods for using such earth-boring drill bits to drill a wellbore in a geological formation.

BACKGROUND

Wellbores are most frequently formed in geological formation using earth-boring drill bits. Cutting action associated with such drill bits generally requires weight on bit (WOB) and rotation of associated cutting elements (e.g., blades). However, contact between the cutting elements and downhole formations generates friction that can result in worn or fatigued cutting elements and scrapped bits. As a result, depth-of-cut control (DOCC) elements are sometimes used proximate to the cutting elements to limit the depth of each cut and minimize over-engagement of the cutting elements (e.g., friction) as the earth-boring drill bit rotates at the end of the wellbore.

BRIEF DESCRIPTION OF THE DRAWINGS

A more complete understanding of the present disclosure and its features and advantages thereof may be acquired by referring to the following description, taken in conjunction with the accompanying drawings, which are not necessarily to scale, in which like reference numbers indicate like features, and wherein.

DETAILED DESCRIPTION

The present disclosure relates to an earth-boring drill bit including DOCCs that include rolling elements. Although the present disclosure discusses in detail an earth-boring drill bit with a plurality of DOCCs that include rolling elements, earth-boring drill bits with only a single DOCC that includes a rolling element according to this disclosure, earth-boring drill bits with both one or a plurality of DOCCs that include rolling elements, and one or a plurality of DOCCs that do not include rolling elements, or do not include rolling elements according to this disclosure, and earth-boring drill bits that include a plurality of DOCCs, all of which are DOCCs that include rolling elements according to this disclosure are all possible and may be produced using this disclosure.

The DOCCs including rolling elements described herein allow rotation, but do not use a nail-lock retention feature.

In particular in DOCCs according to the present disclosure include rolling elements that are secured within a walled retainer, isolating the rolling element from the pocket, such that an exposed portion of the rolling element is positioned to contact a wellbore and rotate within the walled retainer in response to frictional contact with the wellbore. Prior to installation, the walled retainer further includes an enclosure extending vertically from the perimeter of the walled retainer. The enclosure covers the rolling element during installation of the DOCC element into a pocket in the earth-boring drill bit.

DOCC elements of the present disclosure may be disposed on a wide variety of earth-boring drill bits, including steel-body drill bits and matrix drill bits.

The present disclosure and its advantages are best understood by referring to FIGS. 1-6, where like numbers are used to indicate like and corresponding parts.

Figure 1:
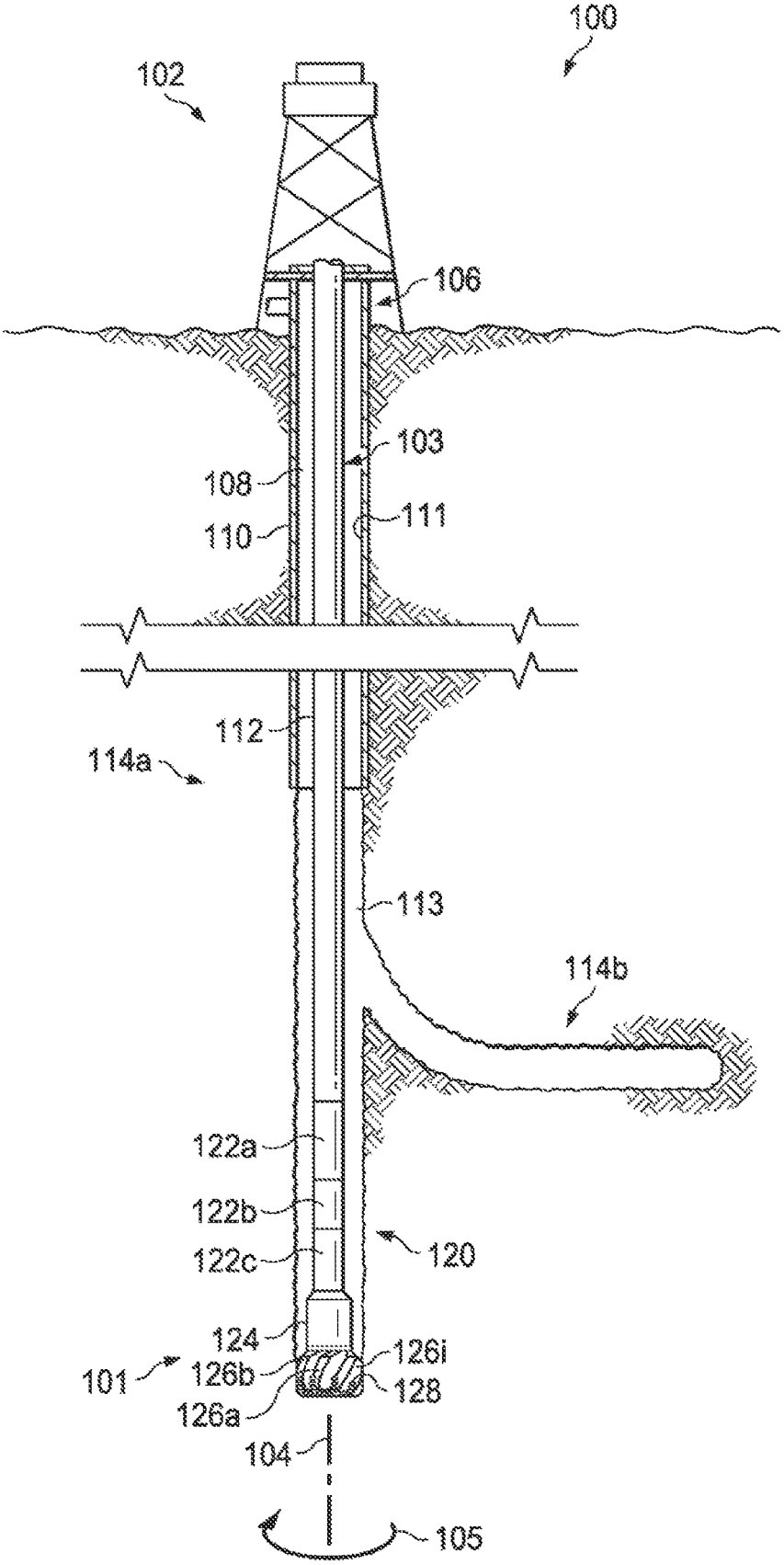
FIG. 1 is a schematic diagram of a drilling system in which an earth-boring drill bit of the present disclosure may be used.

FIG. 1 is a schematic diagram of a drilling system 100 configured to drill into one or more geological formations to form a wellbore. Drilling system 100 may include an earth-boring drill bit 101 according to the present disclosure.

Drilling system 100 may include well surface or well site 106. Various types of drilling equipment such as a rotary table, mud pumps and mud tanks (not expressly shown) may be located at a well surface or well site 106. For example, well site 106 may include drilling rig 102 that may have various characteristics and features associated with a "land drilling rig." However, earth-boring drill bits according to the present disclosure may be satisfactorily used with drilling equipment located on offshore platforms, drill ships, semi-submersibles and drilling barges (not expressly shown).

Drilling system 100 may include drill string 103 associated with earth-boring drill bit 101 that may be used to form a wide variety of wellbores or bore holes such as generally vertical wellbore 114*a* or generally horizontal wellbore 114*b* as shown in FIG. 1. Various directional drilling techniques and associated components of bottom hole assembly (BHA) 120 of drill string 103 may be used to form generally horizontal wellbore 114*b*. For example, lateral forces may be applied to earth-boring drill bit 101 proximate kickoff location 113 to form generally horizontal wellbore 114*b* extending from generally vertical wellbore 114*a*. Wellbore 114 is drilled to a drilling distance, which is the distance between the well surface and the furthest extent of wellbore 114, and which increases as drilling progresses.

BHA 120 may be formed from a wide variety of components configured to form a wellbore 114. For example, components 122*a*, 122*b* and 122*c* of BHA 120 may include, but are not limited to, drill bit, such as earth-boring drill bit 101, drill collars, rotary steering tools, directional drilling tools, downhole drilling motors, reamers, hole enlargers or stabilizers. The number of components such as drill collars and different types of components 122 included in BHA 120 may depend upon anticipated downhole drilling conditions and the type of wellbore that will be formed by drill string 103 and earth-boring drill bit 101.

Wellbore 114 may be defined in part by casing string 110 that may extend from well site 106 to a selected downhole location. Portions of wellbore 114 as shown in FIG. 1 that do not include casing string 110 may be described as "open hole." Various types of drilling fluid may be pumped from well site 106 through drill string 103 to attached earth-boring drill bit 101. Such drilling fluids may be directed to flow from drill string 103 to respective nozzles (item 156 illustrated in FIG. 2) included in earth-boring drill bit 101. The drilling fluid may be circulated back to well surface 106 through annulus 108 defined in part by outside diameter 112 of drill string 103 and inside diameter 118 of wellbore 114. Inside diameter 118 may be referred to as the "sidewall" of wellbore 114. Annulus 108 may also be defined by outside diameter 112 of drill string 103 and inside diameter 111 of casing string 110.

Figure 2:
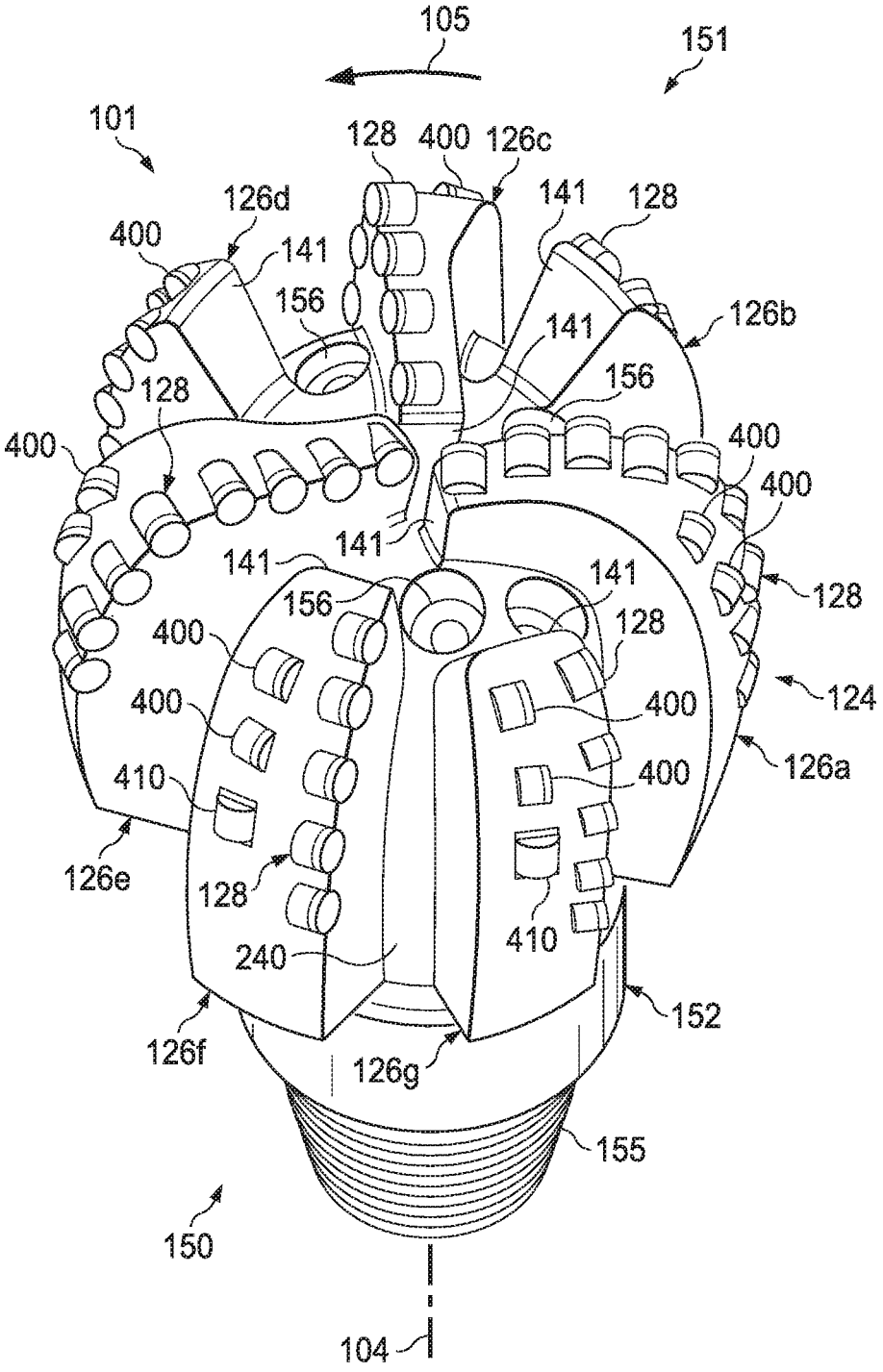
FIG. 2 is an isometric view of an earth-boring drill bit including cutting elements and DOCC elements.

FIG. 2 illustrates an isometric view of a fixed-cutter earth-boring drill bit 101 oriented upwardly in a manner often used to model or design drill bits. Earth-boring drill bit 101 may be used to form wellbore 114 extending through one or more downhole formations. Earth-boring drill bit 101 may be designed and formed in accordance with teachings of the present disclosure and may have many different designs, configurations, and/or dimensions according to the particular application of earth-boring drill bit 101.

Earth-boring drill bit 101 may include one or more blades 126 (e.g., blades 126*a*-126*g*) that may be disposed outwardly from exterior portions of rotary bit body 124 of earth-boring drill bit 101. Rotary bit body 124 may have a generally cylindrical body and blades 126 may be any suitable type of projections extending outwardly from rotary bit body 124. For example, a portion of blade 126 may be directly or indirectly coupled to an exterior portion of bit body 124, while another portion of blade 126 is projected away from the exterior portion of bit body 124. Blades 126 formed in accordance with teachings of the present disclosure may have a wide variety of configurations including substantially arched, helical, spiraling, tapered, converging, diverging, symmetrical, and/or asymmetrical.

In some cases, blades 126 may have substantially arched configurations, generally helical configurations, spiral shaped configurations, or any other configuration satisfactory for use with each downhole drilling tool. One or more blades 126 may have a substantially arched configuration extending from proximate rotational axis 104 of earth-boring drill bit 101. The arched configuration may be defined in part by a generally concave, recessed shaped portion extending from proximate bit rotational axis 104. The arched configuration may also be defined in part by a generally convex, outwardly curved portion disposed between the concave, recessed portion and outerportions of each blade which corresponds generally with the outside diameter of the earth-boring drill bit 101.

Each of blades 126 may include a first end disposed proximate or toward bit rotational axis 104 and a second end disposed proximate or toward outer portions of earth-boring drill bit 101 (e.g., disposed generally away from bit rotational axis 104 and toward uphole portions of earth-boring drill bit 101). The terms "uphole" and "downhole" may be used to describe the location of various components of drilling system 100 relative to the bottom or end of wellbore 114 shown in FIG. 1. For example, a first component described as uphole from a second component may be further away from the end of wellbore 114 than the second component. Similarly, a first component described as being downhole from a second component may be located closer to the end of wellbore 114 than the second component.

Blades 126*a*-126*g* may include primary blades disposed about the bit rotational axis. For example, in FIG. 2, blades 126*a*, 126*c*, and 126*e* may be primary blades or major blades because respective first ends 141 of each of blades 126*a*, 126*c*, and 126*e* may be disposed closely adjacent to associated bit rotational axis 104. Blades 126*a*-126*g* may also include at least one secondary blade disposed between the primary blades. Blades 126*b*, 126*d*, 126*f*, and 126*g* shown in FIG. 2 on earth-boring drill bit 101 may be secondary blades or minor blades because respective first ends 141 may be disposed on downhole end 151 a distance from associated bit rotational axis 104. The number and location of secondary blades and primary blades may vary such that earth-boring drill bit 101 includes more or less secondary and primary blades. Blades 126 may be disposed symmetrically or asymmetrically with regard to each other and bit rotational axis 104 where the disposition may be based on the downhole drilling conditions of the drilling environment. In some cases, blades 126 and earth-boring drill bit 101 may rotate about rotational axis 104 in a direction defined by directional arrow 105.

Each blade may have a leading (or front) exterior surface disposed on one side of the blade in the direction of rotation of earth-boring drill bit 101 and a trailing (or back) exterior surface disposed on an opposite side of the blade away from the direction of rotation of earth-boring drill bit 101. Blades 126 may be positioned along bit body 124 such that they have a spiral configuration relative to rotational axis 104. Blades 126 may also be positioned along bit body 124 in a generally parallel configuration with respect to each other and bit rotational axis 104.

Blades 126 may include one or more cutting elements 128 disposed outwardly from the exterior surface 436 of each blade 126. For example, a portion of cutting element 128 may be directly or indirectly coupled to an exterior surface 436 of blade 126 while another portion of cutting element 128 may be projected away from the exterior surface 436 of blade 126. Cutting elements 128 may be any suitable device configured to cut into a formation, including primary cutting elements, backup cutting elements, secondary cutting elements, or any combination thereof. By way of example and not limitation, cutting elements 128 may be various types of cutters, compacts, buttons, inserts, and gage cutters satisfactory for use with a wide variety of earth-boring drill bits 101.

Cutting elements 128 may include respective substrates with a layer of hard cutting material disposed on one end of each respective substrate. The hard layer of cutting elements 128 may provide a cutting surface that may engage adjacent portions of a downhole formation to form wellbore 114. The contact of the cutting surface with the formation may form a cutting zone associated with each of cutting elements 128. The edge of the cutting surface located within the cutting zone may be referred to as the cutting edge of a cutting element 128.

Each substrate of cutting elements 128 may have various configurations and may be formed from tungsten carbide or other materials associated with forming cutting elements for earth-boring drill bits. Tungsten carbides may include monotungsten carbide (WC), ditungsten carbide ($W_2C$), macrocrystalline tungsten carbide, and cemented or sintered tungsten carbide. Substrates may also be formed using other hard materials, which may include various metal alloys and cements such as metal borides, metal carbides, metal oxides and metal nitrides. Similar materials may be used for rolling elements or hardened portions of walled retainer described herein. For some applications, the hard cutting layer of a cutting element 128 may be formed from substantially the same materials as the substrate. In other applications, the hard cutting layer may be formed from different materials than the substrate. Examples of materials used to form hard cutting layers may include polycrystalline diamond materials, including synthetic polycrystalline diamonds and thermally stable polycrystalline diamond tables.

Figure 3:
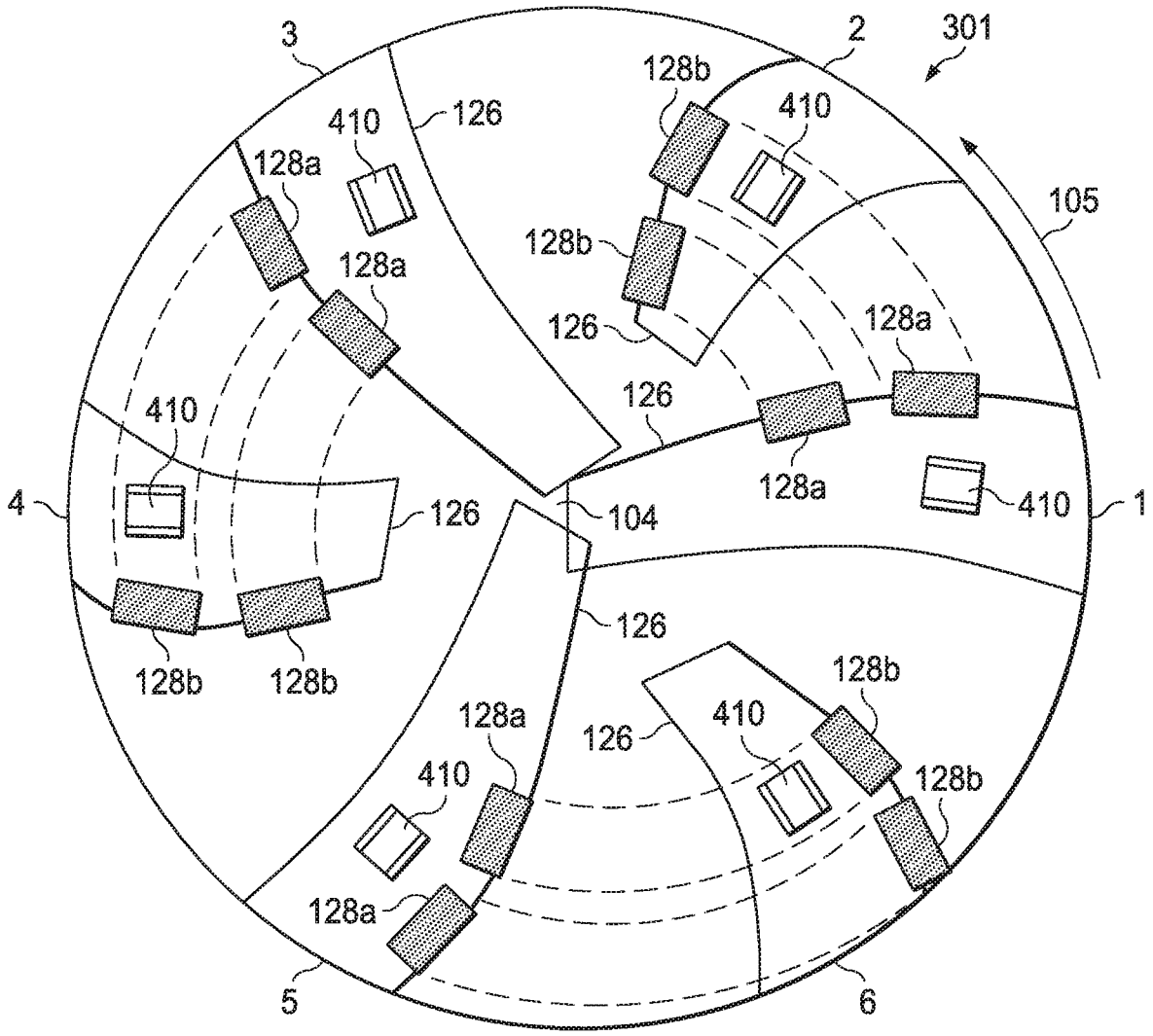
FIG. 3 is a schematic diagram of a bit face of an earth-boring drill bit including cutting elements and DOCC elements.
Figure 4:
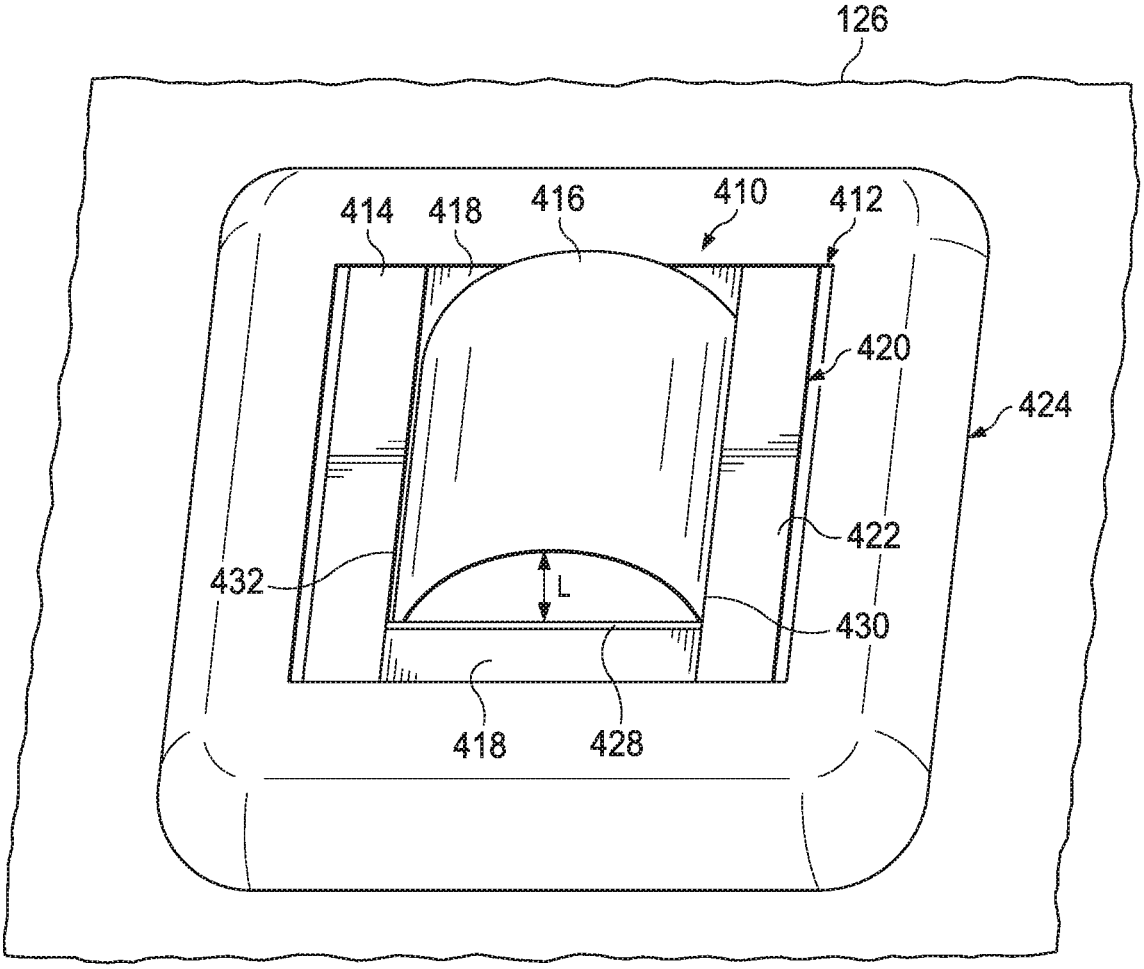
FIG. 4 is a schematic diagram of a DOCC element including a rolling element.
Figure 5:
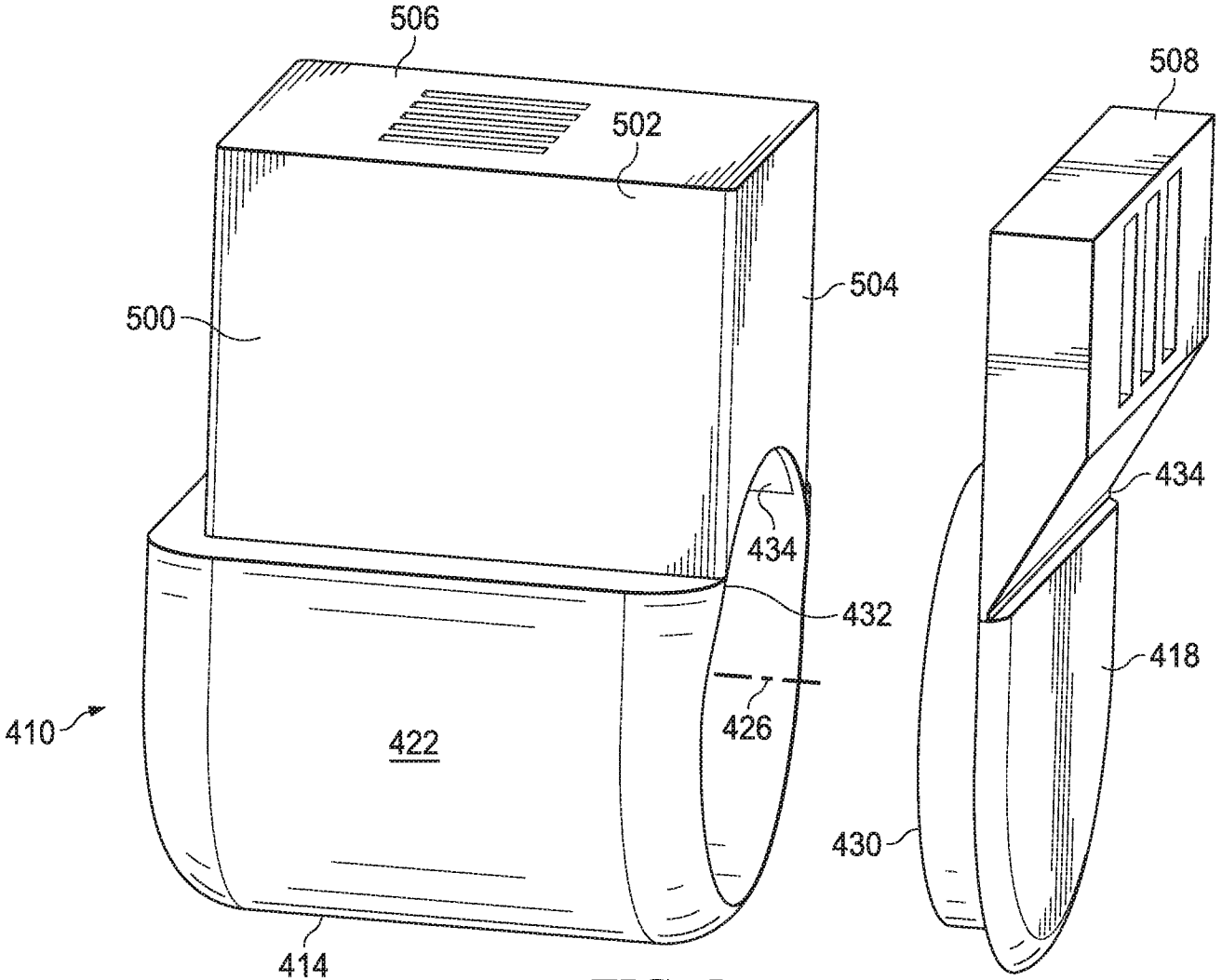
FIG. 5 is a schematic diagram of a DOCC element including an enclosure.

Blades 126 may also include one or more DOCC elements such as DOCC elements 400 or DOCC elements 410 as further illustrated in FIGS. 4-5) configured to control the depth-of-cut of cutting elements 128. Examples of DOCC elements 400, which are not DOCC elements 410, may include an impact arrestor, a second-layer cutting element (which may be similar to cutting element 128*b* in FIG. 3), and/or Modified Diamond Reinforcement (MDR). The number, type and placements or DOCC elements, including DOCC elements 400 and DOCC elements 410, as illustrated in FIG. 2 are for conceptual purposes only. Many variations are possible. For example, an earth-boring drill bit 101 may have only DOCC elements 410, which may be located in the positions illustrated and in place of the DOCC elements 400 illustrated, in different positions, or both. Exterior surfaces 436 of blades 126, cutting elements 128, and DOCC elements may form portions of the bit face.

DOCC elements 410 may be disposed along an exterior surface 436 of each blade 126 such that the rolling elements make contact with the end of wellbore 114 while the earth-boring drill bit 101 is in operation. In particular, the downhole end 151 of each blade 126 may include one or more pockets defined by the blade 126 into which a walled retainer may be secured using alloys (e.g., brazing, welding, soldering, and the like). Each walled retainer includes a rolling element secured inside that is configured to make contact with downhole formations in the wellbore 114 and rotate about its axis within the walled container 414 as the earth-boring drill bit 101 rotates about rotational axis 104. Because the rolling element freely rotates about its axis, friction between the downhole ends 151 of the blades 126 and the end of wellbore 114 may be reduced, stick-slip vibration may be minimized, the overall stability of the drill string 103 may be improved, or any combinations of these effects may be achieved.

Uphole end 150 of earth-boring drill bit 101 may include shank 152 with drill pipe threads 155 formed thereon. Threads 155 may be used to releasably engage earth-boring drill bit 101 with BHA 120, described in detail below, whereby earth-boring drill bit 101 may be rotated relative to bit rotational axis 104. Downhole end 151 of earth-boring drill bit 101 may include a plurality of blades 126*a*-126*g* with respective junk slots or fluid flow paths 240 disposed therebetween. Additionally, drilling fluids may be communicated to one or more nozzles 156.

The rate of penetration (ROP) of earth-boring drill bit 101 is often a function of both weight on bit (WOB) and revolutions per minute (RPM). Referring back to FIG. 1, drill string 103 may apply weight on earth-boring drill bit 101 and may also rotate earth-boring drill bit 101 about rotational axis 104 to form wellbore 114 (e.g., wellbore 114*a* or wellbore 114*b*). The depth-of-cut per revolution may also be based on ROP and RPM of a particular bit and indicates how deeply drill bit cutting elements 128 are engaging the formation.

FIG. 3 is a schematic diagram of an example of a bit face 301 of an earth-boring drill bit 101 that includes cutting elements 128 and DOCC elements 410 disposed on blades. As illustrated in FIG. 3, blades 126 of drill face 301 may be divided into groups including primary blades (1, 3, and 5) and secondary blades (2, 4, and 6). First-layer cutting elements 128*a* may be placed on primary blades (1, 3, and 5) and corresponding second-layer cutting elements 128*b* may be placed on secondary blades (2, 4, and 6), which are respectively located in front of primary blades (1, 3, and 5) with respect to the direction of rotation around bit rotational axis 104 as indicated by rotational arrow 105. Corresponding second-layer cutting elements 128*b* may be track set with corresponding first-layer cutting elements 128*a* (e.g., placed in the same radial position from the bit rotational axis 104) such that drill face 301 is designed with a front track set configuration. Additionally, first-layer cutting elements 128*a* on primary blades (1, 3, and 5) may be single set such that they have a unique radial position with respect to bit rotational axis 104. Each blade includes a DOCC element 410 disposed across primary blades (1, 3, and 5) and secondary blades (2, 4, and 6). Although a particular arrangement is presented in FIG. 3 for conceptual purposes, many variations are possible. The present disclosure may apply to multiple configurations of drill bits with varied blade numbers, varied cutting element placements, including the presence or absence of second-layer cutting elements, varied DOCC element types and placements, including the presence or absence of DOCC elements other than DOCC elements 410, and any combinations of these variations.

FIG. 4 illustrates an example of DOCC element 410. As illustrated in FIG. 4, the DOCC element 410 includes a walled retainer 414 and a rolling element 416. The walled retainer 414 includes retainer side walls 422 and endcaps 418. The DOCC element 410 is located in a pocket 412 and is secured by a brazing interface 420. The DOCC element 410 as illustrated in FIG. 4 is configured to extend the lifespan of earth-boring drill bit 101 by decreasing the amount of wear rolling element 416 exerts on pocket 412. The retainer side walls 422 and end caps 418 may serve as a buffer between rolling element 416 and pocket 412.

The retainer side walls 422 of walled retainer 414 may be a semi-cylinder or other shape that that partially encloses rolling element 416. The semi-cylinder has an inner diameter (referred to as the "retainer diameter") that is slightly greater (e.g. between 0.005 to 0.020 in. inclusive) than the diameter of rolling element 416 (referred to as the "rolling element diameter"). This allows the rolling element 416 to rotate freely about its axis 426, which is located near (e.g. within 0.01 in. of) the axis of semi-cylinder formed by the retainer side walls 422 of the walled retainer 414. The difference in distance between axis 426 and the axis of the semi-cylinder may be less than the difference between the retainer diameter and the rolling element diameter. For example, it may be between 0.01 and 0.005 in., inclusive, less.

The retainer side walls 422 have a gap 428 extending between edges 432. The gap 428 has a length between edges 432 that is less than the diameter of rolling element 416. This allows rolling element 416 to be partially exposed and not wholly covered by retainer side walls 422. This partially exposed portion of rolling element 416 extends a maximum distance "L" above the top of pocket 412, which may be the exterior surface 436 of the blade 126, such that the rolling element 416 may contact the formation when the earth-boring drill bit 101 is in use and, when in contact with the formation and subject to a tangential or frictional force, freely rotate about its axis 426 (illustrated in FIG. 5). For example, the length between the axis 426 of the rolling element 416 and the top of the walled retainer 414 (where maximum distance "L" begins) may be between 0.17 and 0.20 in. This ensures that the curvature of the walled retainer 414 extends beyond the axis 426 of the rolling element 416, thus providing for retention of the rolling element 416 inside.

During the drilling process, the walled retainer 414 may also make frictional contact with downhole formations, which can cause excessive wear and result in failure. To reduce this risk, one, more than one, or each surface of the walled retainer 414 that comes into frictional contact with downhole formations may be covered by a layer of tungsten carbide, other carbide, or other abrasion-resistant material to resist abrasion. The abrasion-resistant material may be laser-deposited. The walled retainer 414 may be formed from a carbide, such as tungsten carbide, particularly 3D-printed carbide, such as tungsten carbide, or cast from tungsten carbide powder.

The rolling element 416 may include an abrasion-resistant material, such as a material having a Brinell hardness of 1500 or greater. Such materials may include polycrystalline diamond compact (PDC) or a carbide, such as tungsten carbide. The PDC or carbide may form the entirety of the rolling element 416, or it may form an outer layer of the rolling element 416, with an inner portion being formed from another material. In addition, if only an outer layer of the rolling element 416 is formed from PDC or a carbide, or another abrasion-resistant material, the entire outer layer may be formed from the abrasion-resistant material, or only a portion thereof, such as only the sides, but not the end of the cylindrical rolling element 416 structure. As illustrated in FIG. 4, the rolling element 416 is secured within the walled retainer 414 by two endcaps 418 at either end of the walled retainer 414. Alternatively, as illustrated in FIG. 5, the walled retainer 414 may have only one open end, and the rolling element 416 may be secured within the walled retainer 414 using only one endcap 418.

The endcap 418 may be slightly tapered on outer edge 430, such that the tapered side may be pressed into the walled retainer 414 to create a tight seal. Each endcap 418 might alternatively have an outer edge 430 that is slightly larger (e.g., between 0.005 and 0.015 in., inclusive) than the retainer, facilitating retention by friction. Endcap 418 may include a deformable element (e.g., elastic, rubber, foam, etc.) wholly or partially around the circumference of its outer edge 430. The deformable element allows the endcap 418 to be pressed into an end of the walled retainer 414 and held in place by friction. The endcap 418 may alternatively or in addition be slightly undersized to fit without force into opening 432, and refractive paint (stop-off) that inhibits the flow of braze can be placed to both protect the rolling element from being locked by braze and hold end caps 418 in place. Once end caps 418 are secured into position, DOCC element 410 can be brazed into pocket 412.

Pocket 412 is defined by blade 126 and includes a recessed area positioned in the exterior surface 436 of blade 126. The pocket 412 may be surrounded by a raised area, such as raised area 424 illustrated in FIG. 4, or the top of pocket 412 may simply be flush with the normal profile of the exterior surface 436 blade 126. The DOCC element 410 may be secured in the pocket 412, for example by metallurgical bonding between at least the retainer side walls 422, the end caps 418, and the pocket 412. In the example shown in FIG. 4, the DOCC element 410 is secured using a braze alloy. The pocket 412 may be coated with braze alloy before receiving the DOCC element 410, and subsequently brazed along the brazing interface 420 to secure the DOCC element 410 in place. The DOCC element 410 might also be secured in the pocket 412 by soldering, or any other suitable technique for metallurgically bonding components.

The brazing interface 420 may be uniform in width surrounding the perimeter of the walled retainer 414. The brazing interface may provide a durable bond to secure the DOCC element 410 within the pocket 412 without additional mechanisms, such as nail-locked retention clips, for example.

If the pocket 412, walled retainer 414, rolling element 416, and/or endcaps 418 become worn or fatigued from use, the brazing interface 420 may be de-brazed in order to remove the DOCC element 410 for repair or replacement. In this way, the brazing interface 420 provides a way to repair or replace the DOCC element 410 without requiring several hours to break down adhesive bonds, such as those used to secure nail-locked retention clips.

FIG. 5 illustrates an example of a DOCC element 410 and an enclosure 500. As illustrated in FIG. 5, the DOCC element 410 includes a walled retainer 414, an endcap 418, an enclosure 500, and a rolling element (not shown in figure).

Figure 6:
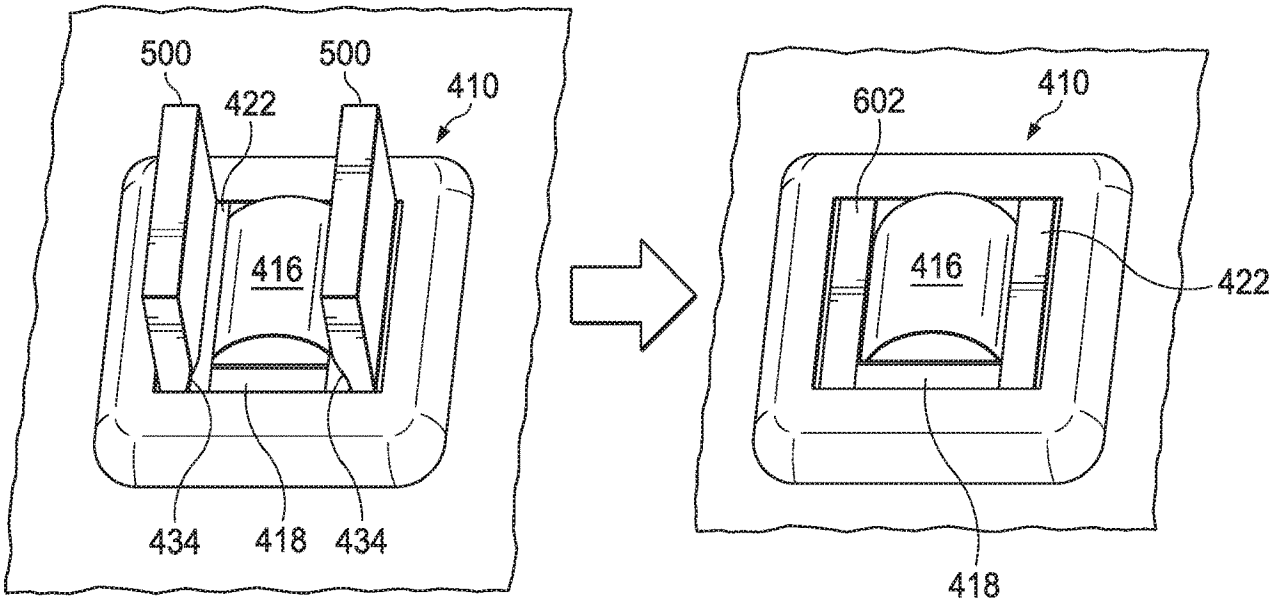
FIG. 6 is a schematic diagram of a DOCC element before and after having an enclosure removed.

The walled retainer 414 initially includes enclosure 500 which has enclosure side walls 502 that extend vertically from tangent points that will form edges 432 of the retainer side walls 422. Enclosure 500, as illustrated in FIG. 5, may also include end walls 504 and top 506. Endcap 418 may further include an endcap wall 508 that may form part of enclosure 500. In some examples, enclosure 500 may include only enclosure side walls 502 (e.g., as shown in FIG. 6), or enclosure side walls 502 and only one, or less than all of end walls 504, top 506, and endcap wall 508. Enclosure 500, particularly enclosure side walls 502, may be used to maneuver the DOCC element 410 into the pocket 412.

Enclosure 500, particularly side walls 502, may also protect the rolling element 416 while the DOCC element 410 is being brazed or otherwise secured into the pocket 412. For example, enclosure 500 may prevent molten braze from wicking into the walled retainer 414 and locking the rolling element 416 into place, which would prevent its rotation. Alternatively, a graphite cover may be inserted between the walls of the enclosure 500 to further protect the rolling element 416 from molten braze and flux during the brazing process. The graphite cover may be machined to conform to the space between the walled retainer 414 and the rolling element 416. The graphite cover may be removed from enclosure 500 once brazing is complete and may be reused given graphite's ability to withstand high temperatures during the brazing process. Alternatively, stop-off may be applied to areas proximate to the rolling element 416 prior to brazing in order to prevent the flow of molten braze into the walled retainer 414 during the brazing process. Each of the examples described above may be implemented separately, in various combinations, or in any other suitable manner for protecting rolling element 414 during the brazing process.

Enclosure 500 is typically removed after the DOCC element 410 is secured in pocket 412 and before drilling commences. For example, enclosure 500 may simply be knocked loose by blunt force (e.g., such as that caused by a crescent wrench, hammer and chisel, and the like). However, it is possible to leave enclosure 500 in place and allow it to be removed during the drilling process.

Enclosure 500 may be designed to facilitate its removal. For example, the walls of enclosure 500 may be thin, having a thickness of between 0.015-0.02 in. at the base, then increasing thickness to 0.03-0.05 in. Alternatively or in addition, enclosure 500 may have one or more notches 434, located proximate to edges 432, which are particularly thin (e.g. having a thickness of 0.015-0.02 in.), which causes enclosure 500 to break away from the DOCC element 410 at notches 434 when a force, such as a blunt force, is applied to enclosure 500.

FIG. 6 is an illustration of an example process for removing an enclosure 500. As illustrated in FIG. 6, the enclosure 500 includes two walls. Each wall includes a notch 434 proximate to its base. The notches 434 are formed as the lower section of each wall tapers to a point of contact with either side of walled retainer 414. The notch 434 is configured such that each wall comprising the enclosure 500 may be removed easily post-brazing. Once the enclosure 500 is removed, the top surface 602 of walled retainer 414 is exposed. The top surface 602 may receive a laser-deposited layer of tungsten carbide to resist abrasion from contact with downhole formations during operation. The notch 434 or thin walls 502 and 504 at the base of each wall leave adequate area on top surface 602 for hardfacing.

Figure 7:
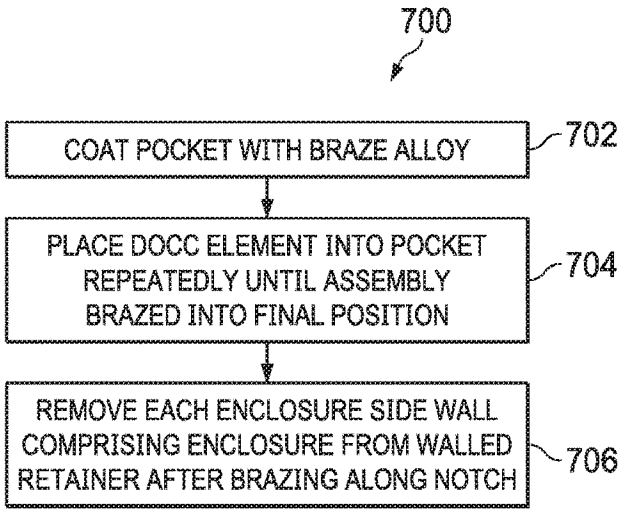
FIG. 7 is a flow chart of a process for installing a DOCC element and removing an enclosure.

FIG. 7 is a flowchart 700 of an example process for installing a DOCC element 410 into a pocket 412 and removing an enclosure 500 after brazing. The pocket 412 receives a coat 702 of braze alloy before placing the DOCC element 410 inside the pocket 412. The assembly may be placed 704 into, and removed from, the pocket 412 repeatedly in order to wet the mating surfaces until the DOCC element 410 is brazed into position within the pocket 412. When the DOCC element 410 is in its final position within the pocket 412, each enclosure side wall 502, and/or each end wall 504, comprising the enclosure 500 may be removed 706 from the walled retainer 414 along its notch 434 when a blunt force is applied. Alternatively, enclosure side walls 502, end walls 504, top 506, and/or endcap walls 508 may all be removed simultaneously as one unit (i.e., enclosure 500).

In an embodiment A, the present disclosure provides an earth-boring drill bit including a bit body, a blade on the bit body, the blade having an exterior surface and defining at least one pocket, and a DOCC element positioned within the pocket that includes: a walled retainer positioned within the pocket, the walled retainer including retainer side walls and an endcap attached to the retainer side walls at an end of the walled retainer; and a rolling element positioned within and partially enclosed by the walled retainer, with a portion thereof extending above the exterior surface of the blade.

The present disclosure further provides in an embodiment B a DOCC element including a walled retainer containing retainer side walls and an endcap attached to an end of the retainer side walls at and end of the walled retainer, and a rolling element positioned within and partially enclosed by the walled retainer.

The disclosure further provides in an embodiment C a method of installing a DOCC in an earth-boring drill bit by coating a DOCC element, such as that of embodiment B, with a braze alloy, then placing the coated DOCC element in a pocket defined by a blade on a bit body of an earth boring-drill but such that a portion of the rolling element extends above an exterior surface of the blade.

Embodiment A may be formed using a method of Embodiment C and using and DOCC element of Embodiment B.

Embodiments A, B, and C may be further characterized by the following additional features, which may be combined with one another unless clearly mutually exclusive:

i) the rolling element may include an abrasion-resistant material;

ii) the DOCC may further include an enclosure extending vertically from a perimeter of the walled retainer, where the enclosure covers the rolling element during installation of the walled retainer into the pocket;

iii); the enclosure may include a plurality of thin walls, where each of the plurality of walls includes a notch or thin wall proximate to its base.

iv) the endcap may include an outer edge having a circumference larger than an inner diameter of the walled retainer.

v) the walled retainer may be a semi-cylinder including printed steel.

vi) the walled retainer may include a tungsten carbide surface deposited onto the printed steel.

vii) the walled retainer may be a semi-cylinder including cast or printed tungsten carbide.

viii) the bit body may include a polycrystalline diamond compact (PDC) bit including one of a matrix-body drill bit or a steel-body drill bit; and ix) removing the enclosure after placing the coated DOCC element in a pocket in the blade of a drill bit.

Although the present disclosure has been described with several embodiments, various changes and modifications may be suggested to one skilled in the art. For example, although the present disclosure describes configurations of rolling elements with respect to earth-boring drill bits, the same principles may be used to reduce friction experienced by components of any suitable drilling tool according to the present disclosure. It is intended that the present disclosure encompasses such changes and modifications as fall within the scope of the appended claims.

What is claimed is:

1. An earth-boring drill bit, comprising:

a bit body;

a blade on the bit body, the blade having an exterior surface and defining at least one pocket; and a depth-of-cut control (DOCC) element positioned within the pocket, the DOCC element including:

a walled retainer positioned within the pocket, the walled retainer including retainer side walls and an endcap attached to the retainer side walls at an end of the walled retainer;

a rolling element positioned within and partially enclosed by the walled retainer, with a portion thereof extending above the exterior surface of the blade; and an enclosure extending vertically from a perimeter of the walled retainer, the enclosure covering the rolling element.

2. The earth-boring drill bit of claim 1, wherein the rolling element comprises an abrasion-resistant material.

3. The earth-boring drill bit of claim 1, wherein the enclosure covers the rolling element during an installation of the walled retainer into the pocket.

4. The earth-boring drill bit of claim 1, wherein the enclosure comprises a plurality of thin walls and a top, each of the plurality of thin walls including a notch proximate to its base.

5. The earth-boring drill bit of claim 1, wherein the endcap comprises an outer edge having a circumference larger than an inner diameter of the walled retainer.

6. The earth-boring drill bit of claim 1, wherein the walled retainer is a semi-cylinder comprising printed steel.

7. The earth-boring drill bit of claim 6, wherein the walled retainer comprises a tungsten carbide surface deposited onto the printed steel.

8. The earth-boring drill bit of claim 1, wherein the walled retainer is a semi-cylinder comprising cast or printed tungsten carbide.

9. The earth-boring drill bit of claim 1, wherein the bit body is a polycrystalline diamond compact (PDC) bit comprising one of a matrix-body drill bit or a steel-body drill bit.

10. A depth-of-cut control (DOCC) element comprising:

a walled retainer including retainer side walls and an endcap attached to an end of the retainer side walls at an end of walled retainer;

a rolling element positioned within and partially enclosed by the walled retainer; and an enclosure extending vertically from a perimeter of the walled retainer, the enclosure covering the rolling element.

11. The DOCC element of claim 10, wherein the rolling element comprises an abrasion-resistant material.

12. The DOCC element of claim 10, wherein the enclosure comprises a plurality of thin walls and a top, each of the plurality of thin walls including a notch proximate to its base.

13. The DOCC element of claim 10, wherein the endcap comprises an outer edge having a circumference larger than an inner diameter of the walled retainer.

14. The DOCC element of claim 10, wherein the walled retainer is a semi-cylinder comprising printed steel.

15. The DOCC element of claim 14, wherein the walled retainer comprises a tungsten carbide surface deposited onto the printed steel.

16. The DOCC element of claim 10, wherein the walled retainer is a semi-cylinder comprising cast or printed tungsten carbide.

17. The DOCC element of claim 10, wherein the bit body is a polycrystalline diamond compact (PDC) bit comprising one of a matrix-body drill bit or a steel-body drill bit.

18. A method of installing a depth-of-cut control (DOCC) in an earth-boring drill bit, the method comprising:

coating a DOCC element with a braze alloy, wherein the DOCC element includes:

a walled retainer including retainer side walls and an endcap attached to an end of the retainer side walls at an end of walled retainer;

a rolling element positioned within and partially enclosed by the walled retainer; and an enclosure extending vertically from a perimeter of the walled retainer, the enclosure covering the rolling element; and placing the coated DOCC element in a pocket defined by a blade on a bit body of an earth boring-drill but such that a portion of the rolling element extends above an exterior surface of the blade.

19. The method of claim 18, the enclosure covers the rolling element during an installation of the walled retainer into the pocket, and the method further comprises removing the enclosure after placing the coated DOCC element in the pocket.

* * * * *